United States Patent [19]

Ballo et al.

[11] 4,358,995

[45] Nov. 16, 1982

[54] APPARATUS FOR CRUSHING ARTICLES

[75] Inventors: James A. Ballo, Elm Grove; Charles F. Constable, Racine, both of Wis.

[73] Assignee: Vivitar Corporation, Santa Monica, Calif.

[21] Appl. No.: 183,399

[22] Filed: Sep. 2, 1980

[51] Int. Cl.[3] ..... B30B 9/32

[52] U.S. Cl. ..... 100/98 R; 100/100; 100/156; 100/173; 100/210; 100/902; 241/99; 241/239; 241/242

[58] Field of Search ..... 100/210, 98 R, 100, 100/155 R, 156, 173, 902; 241/99, 239, 241, 242

[56] References Cited

U.S. PATENT DOCUMENTS

| | | | |
|---|---|---|---|
| 1,509,730 | 9/1924 | Hughes | 100/210 X |
| 3,011,430 | 12/1961 | Bloomquist | 100/98 R |
| 4,014,256 | 3/1977 | Davis | 100/DIG. 2 |
| 4,106,708 | 8/1978 | Kropa | 241/242 |
| 4,179,018 | 12/1979 | Miller | 100/DIG. 2 |

*Primary Examiner*—Billy J. Wilhite

*Attorney, Agent, or Firm*—Costas, Montgomery & Dorman

[57] ABSTRACT

An apparatus for crushing articles, such as aluminum beverage cans. The crushing apparatus comprises a rotatable, polygonal-shaped drum having blades mounted on each flat outer surface of the drum which project outwardly beyond the respective surface. The articles to be crushed are introduced into the area between the drum and a spring-loaded pressure plate, and on rotation of the drum, the blades engage the articles and move them into the nip between the drum and pressure plate to crush and flatten the articles. The apparatus also includes a quick release mechanism in which the pressure plate can be readily released to correct a jamming situation.

10 Claims, 4 Drawing Figures

APPARATUS FOR CRUSHING ARTICLES

BACKGROUND OF THE INVENTION

Recently there have been increased efforts to reclaim aluminum cans, such as those used for soft drinks and beer. At reclamation distribution locations the cans are crushed or flattened to reduce the volume for shipment. The can crushers, as used in the past, have comprised a large rubber-covered drum that cooperates with a rotating steel drum having angle-shaped blades. The cans are introduced into the area between the drums and the angle-shaped blades move the cans into the nip between the drums to thereby crush or flatten cans.

The can crushing apparatus as used in the past, has several disadvantages. Due to the use of the rubber covered drum, the crusher cannot be used for crushing glass bottles, or other sharp materials. Furthermore, dinner plates of aluminum tend to jam in the crushing mechanism. Also the final crushed can flatness is limited by the resiliency of the rubber drums.

The conventional crusher is also designed specifically for cans of the size of the normal soft drink or beer can and cannot accommodate larger-sized containers made of aluminum.

SUMMARY OF THE INVENTION

The invention is directed to an improved apparatus for crushing articles, such as aluminum cans or glass bottles. The crushing apparatus comprises a rotatable, polygonal-shaped drum composed of a series of flat outer surfaces. Sharpened blades are mounted flatwise on each surface and project beyond the respective surface.

The cans or other articles to be crushed are introduced into the area between the drum and a spring loaded pressure plate, and on rotation of the drum, the blades engage the cans and move them into the nip between the drum and the plate to thereby crush or flatten the cans.

The apparatus also includes a quick release mechanism in which the spring loaded pressure plate can be readily released in the event large incompressible articles are wedged in the nip between the drum and the pressure plate.

The apparatus of the invention can effectively crush a wide variety of materials, such as metal cans, glass bottles, plastic bottles, and the like. Due to the fact that there are no rubber or plastic surfaces on the crushing elements, sharp materials can be crushed without danger to the working components.

As the crushing apparatus includes a spring loaded pressure plate, the apparatus can effectively crush various sized cans and bottles without modification or adjustment to the equipment.

The polygonal-shaped drum with the attached blades effectively flattens the cans and enables a greater weight of crushed cans to be stored in a given volume.

The apparatus is adapted to be mounted on wheels or casters so that it is mobile and can be moved between various operating sites. The crushing mechanism itself, is relatively small in size so that the entire unit is more compact than crushing devices as used in the past.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
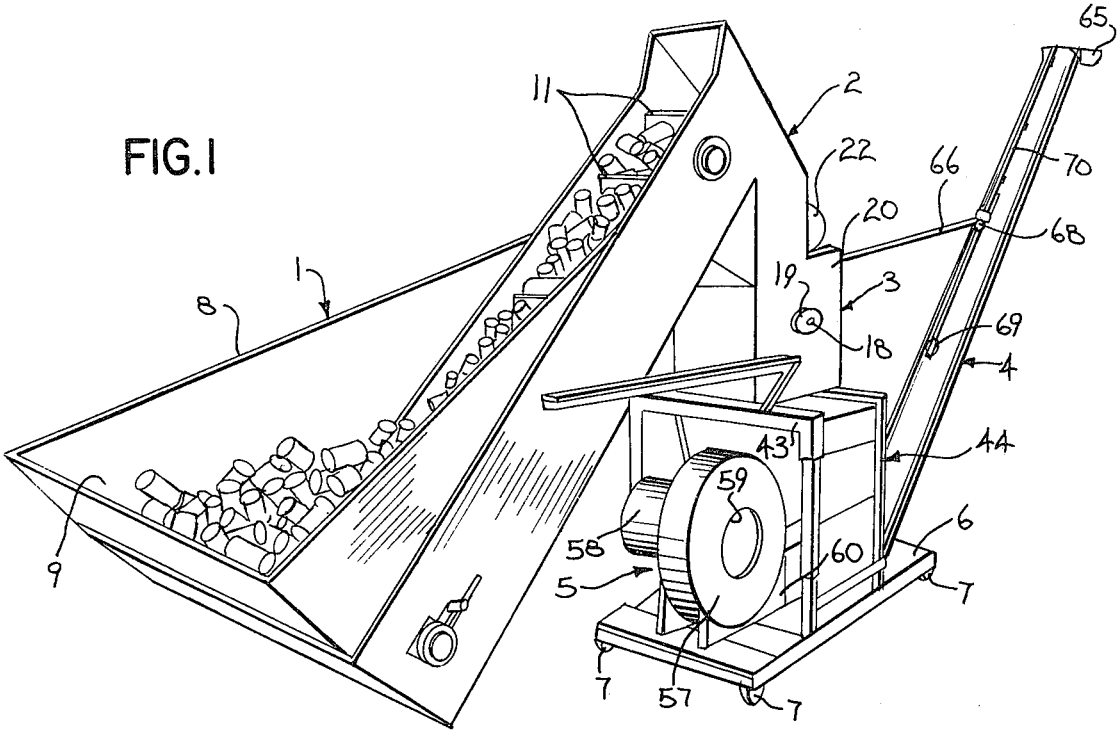
FIG. 1 is a perspective view of the crushing apparatus of the invention.

The crushing apparatus of the invention, as illustrated in FIG. 1, includes a feed conveying unit 1 which receives the articles to be crushed, such as aluminum cans or glass bottles, and conveys the articles upwardly to a hopper 2. The articles are fed by the hopper into a crushing unit 3 which crushes or flattens the articles, and the crushed articles are then discharged through an inclined discharge tube 4 by operation of a blower unit 5.

The hopper 2, crusher unit 3, blower unit 5 and tube 4 can be mounted on a mobile base or platform 6 which is supported by casters or wheels 7, so that the entire crushing apparatus can be moved from site-to-site.

Figures 2, 4:
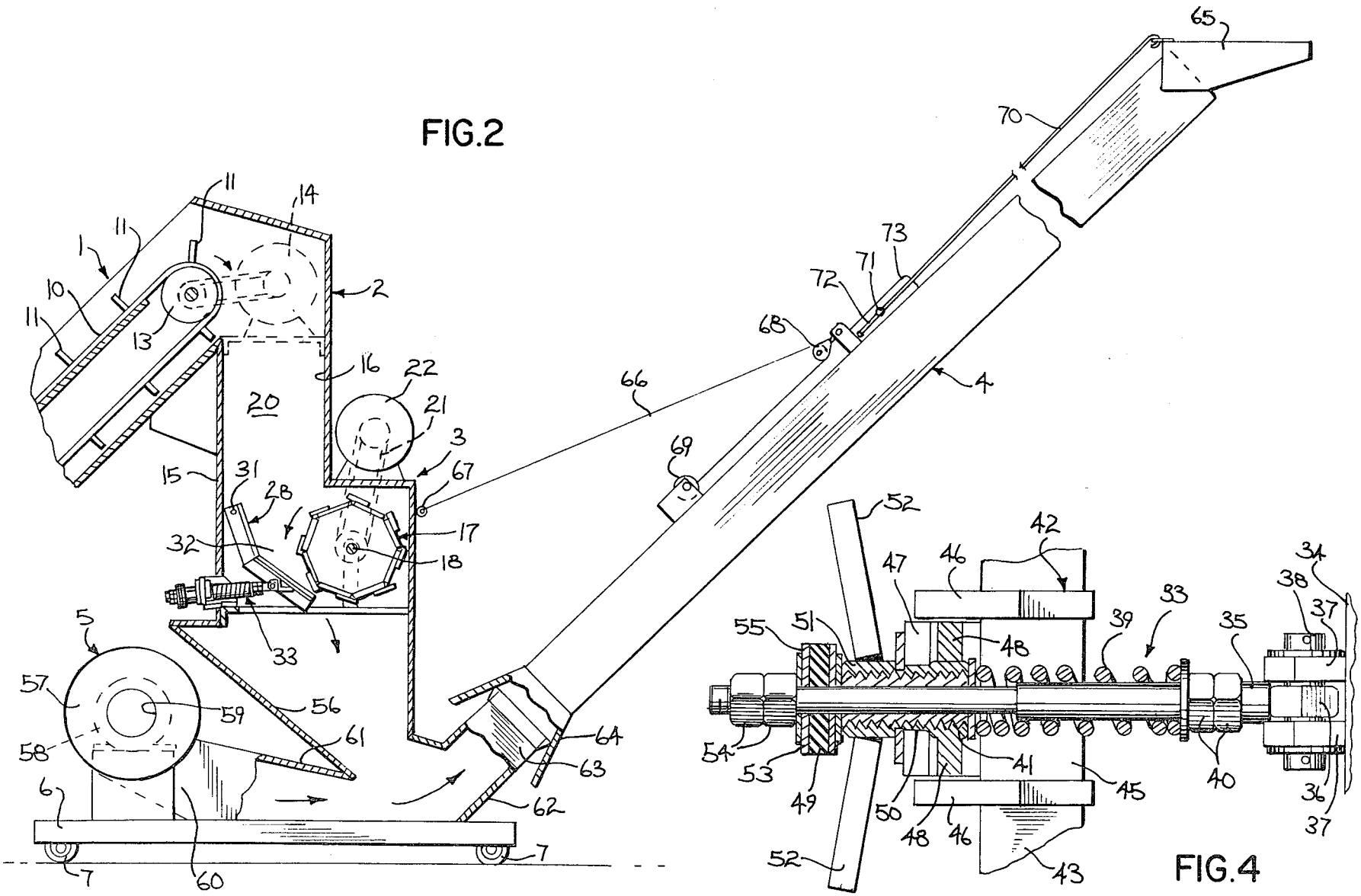
FIG. 2 is a vertical section of the apparatus.
FIG. 4 is a view taken along line 4—4 of FIG. 3.

The feed conveying unit 1 includes a housing 8, the lower end of which defines a bin 9 into which the articles are introduced. An endless belt conveyor 10 is mounted for travel within the housing and carries a series of transverse cleats 11 which convey the articles upwardly into the hopper 2. As shown in FIG. 2, the upper end of the belt conveyor 10 is trained over a drive pulley 13, and the pulley is driven through a chain drive from a motor 14 which is mounted on the crusher unit 3. The lower end of the endless belt 10 is trained over an idler pulley mounted within the housing 8 and not shown in the drawings.

The crusher unit 3 includes an outer housing or casing 15 having an upper inlet 16 which communicates with the hopper 2 so that the cans or other articles being dumped into the hopper by the conveyor 10 will fall through the inlet opening 16 into the housing. Mounted for rotation within the housing 15 is a polygonal-shaped drum 17. The shaft 18 of drum 17 is journalled within suitable bearing assemblies 19 mounted on the side walls 20 of housing 15, and one end of the shaft 18 is connected through a chain drive 21 to a motor 22 which is mounted adjacent the housing 15 on platform 6. Operation of the motor 22 will drive the drum 7, preferably at a speed of about 300 rpm, in the direction of the arrow, as indicated in FIG. 2.

Figure 3:
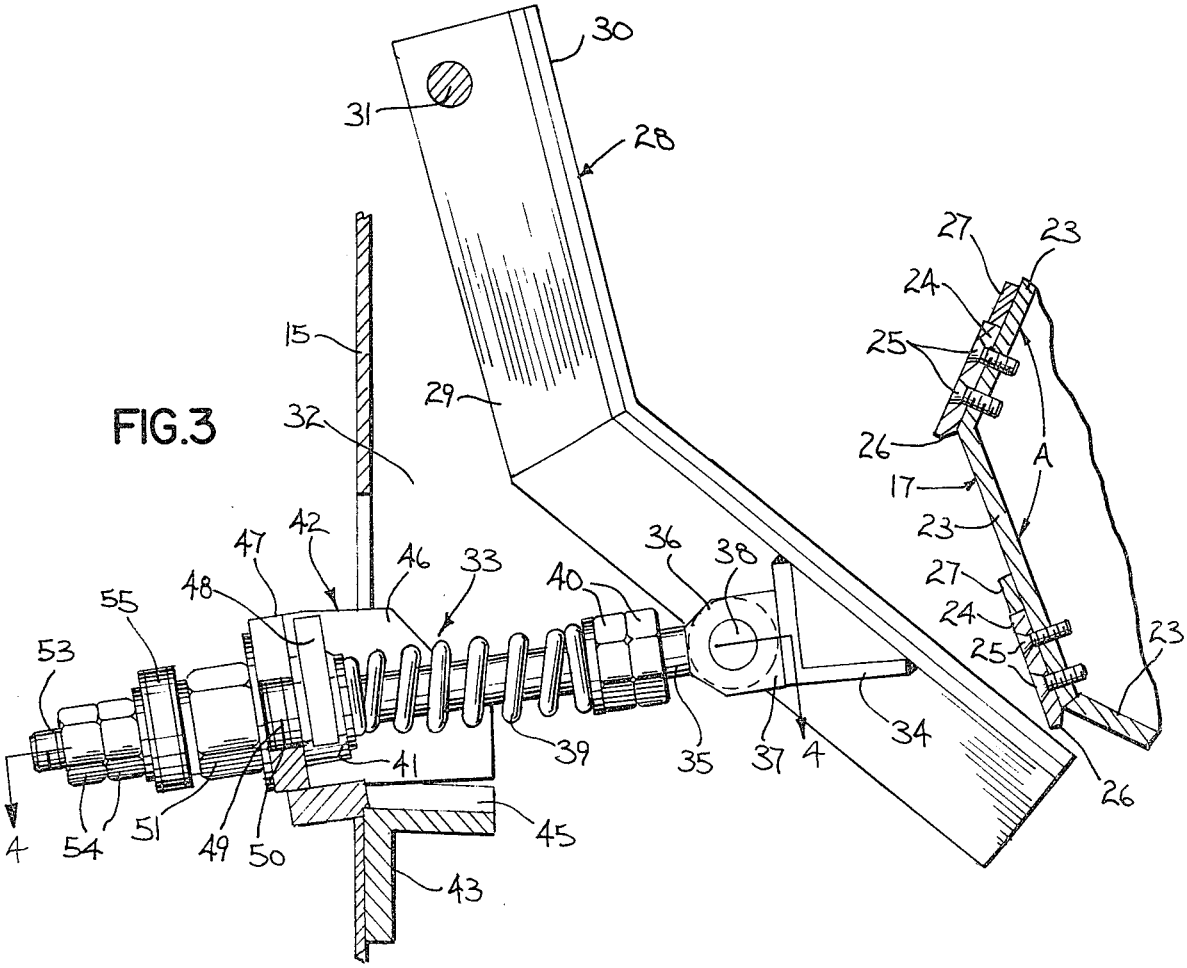
FIG. 3 is an enlarged vertical section showing the drum and the spring loaded pressure plate.

The drum 17, as best shown in FIGS. 2 and 3, is composed of a series of generally flat plates or sections 23 which are welded together to provide the polygonal shape for the drum. As shown in the drawings, the drum is octagonal in cross section with the included angle A, shown in FIG. 3, between the sections being 120°. However, it is contemplated that the drum, depending on its diameter, can preferably be composed of from 6 to 12 sections with the included angle A being in the range of 120° to 150°.

A blade 24, which extends longitudinally the full length of the drum, is secured to each of the sections 23 by counter-sunk screws 25, and the forward sharpened edge 26 of each blade projects beyond the respective drum section 23, as best illustrated in FIG. 2. In addition to the screws 25, the side edges of each blade 24 can be tack welded to the sections 23, and to provide added reinforcement for the blades, a shear plate 27 is welded to each section 23 and abuts the rear edge of the respective blade.

A pressure plate 28 is mounted within the housing 15 and extends the full length of the drum 17. As shown in FIG. 3, the pressure plate has a generally dogleg configuration and is composed of a pair of side angles 29 which are connected by a plate 30. The upper end of the pressure plate 28 is pivotally connected to the housing 15 through shaft 31 and the lower end of the pressure plate is normally disposed in close proximity to the circle inscribed by the sharpened edges 26 of the blades 24. Spacing the lower edge of the pressure plate 28 out of contact with the blades 24 of drum 17, substantially reduces the noise of the crushing operation.

The cans or other articles to be crushed are introduced from the hopper 2 through inlet 16 into the chamber 32 between the pressure plate and the drum. Blades 24 engage the cans and move them into the nip between the drum 17 and the pressure plate 28 where the cans are flattened or crushed.

Pressure plate 28 is biased toward the drum 17 by a spring assembly 33 and can move in a direction away from the drum 17, against the force of the spring, to accommodate enlarged sections of the articles being crushed. The spring assembly 33 includes an angle 34 which is attached to the rear of the pressure plate, and the inner end of a shaft 35 is provided with an eye 36 which is pivotally connected to lugs 37 on angle 34 by a pin 38.

A spring 39 is mounted on shaft 35 and extends between adjusting nuts 40, which are threaded on the end of shaft 35, and nut 41. The nut 41 is restrained against axial movement by a bracket 42 which is mounted on the horizontal angle 43 of frame 44.

As shown in FIGS. 3 and 4, the bracket 42 is composed of a base 45, which rests on the angle 43, and side walls 46 extend upwardly from the base. In addition, an end wall 47 extends upwardly from the base and extends between side walls 46. Nut 41 bears against end wall 47, and the nut is provided with a pair of outwardly extending lugs 48 which, through engagement with the base 45, will prevent rotation of the nut with respect to the bracket 42.

Nut 41 is theaded on the inner end of a sleeve 49, and the sleeve extends freely through a slot 50 formed in end wall 47 of bracket 42, and the outer end of the sleeve received a nut 51 having a pair of outwardly extending arms 52.

As best shown in FIG. 4, the outer end of shaft 35 has a reduced diameter, as indicated by 53, and extends freely through the central bore of sleeve 49. The outer threaded end of shaft extension 53 receives adjusting nuts 54, and a resilient washer assembly 55 is interposed between the innermost nut 54 and the nut 51.

Threaded adjustment of nuts 40 will vary the force of the compression spring 39, while the adjustment of nuts 54 will adjust the clearance between the lower end of the pressure plate 28 and the blades 24 on the drum.

During operation, if an enlarged or thick, incompressible mass passes into the nip between the drum 17 and the pressure plate 28, the pressure plate will move outwardly, against the force of the spring 39, to accommodate the enlargement. When the enlargement has passed through the nip, the spring 39 will return the pressure plate 28 to its original position.

In some instances, the cans may contain substantial quantities of foreign material which provides an enlarged solid mass of greater size than that which can be accommodated by the spring biasing action of spring 39, with the result that the solid chunk may jam in the nip. The invention includes a quick release mechanism which enables the operator to readily release the pressure plate 28 so that the obstruction can be removed. To provide the quick release, the operator will strike the arms 52 on nut 51 to loosen the nut and the entire spring assembly 33 can then be raised to lift the nut 41 out of engagement with the bracket 42. When the nut has cleared the end wall 47 of the bracket, the spring assembly 33 and the pressure plate 28 can be moved outwardly to remove the obstruction.

After being crushed, the cans or other articles fall downwardly within the housing onto an inclined bottom wall 56 and the cans are delivered into the discharge tube 4 by a stream of air created by the blower unit 5. The blower unit 5 includes a conventional fan or blower 57 which is mounted on the base 6 and is driven through a motor 58. Air is drawn to the blower through a central inlet 59 and is discharged through a tangential outlet 60 which is connected to the generally horizontal duct 61, the end of which terminates at the bottom of the inclined wall 56. The cans or other articles moving downwardly along the wall 56 will be picked up in the fast moving stream of air and delivered into the duct 62 which communicates with the lower end of the discharge tube 4. As best shown in FIG. 2, the outer end of duct 62 includes an inclined section 63 having a generally square cross section with bent-in corners, which is freely disposed within the lower conical end 64 of the discharge tube.

The crushed articles being conveyed upwardly through the discharge tube 4 are deflected to a suitable collection site by a deflector 65 which is pivotally connected to the upper end of the tube 4.

The inclination of the discharge tube can be varied through operation of an adjusting cable 66. One end of the cable 66 is dead-ended at 67 on the housing 15. The cable passes over pulley 68 mounted on the discharge tube and the opposite end of the cable is connected to a winch 69. Operation of the winch will serve to raise and lower the discharge tube 4, as desired, and the connection of the square section 63 with the conical lower end 64 of tube 4 permits the tube to pivot relative to the housing.

The attitude of the deflector 65 can also be varied. In this regard a rod 70 is connected to the deflector and the lower end of the rod carries a bolt 71 which is slidably received within a slot 72 in bracket 73 mounted on the discharge tube. Movement of the rod longitudinally will vary the angular position of the deflector and tightening of the bolt 71 will thereby lock the rod 70 and deflector 65 in the desired position.

Maximum flattening can be achieved in a crushing apparatus by minimizing the spacing between the periphery of the rotating drum and the cooperating pressure member. However, it is also necessary to incorporate blades or other sharp edge members on the drum in order to engage the cans and carry them into the nip, otherwise the cans would merely "float" in the space above the nip. Incorporating overhanging blades on the drum necessarily increases the spacing between the drum periphery and the pressure member and thereby decreases the flattening effect. By utilizing the polygonal surfaces on drum 17, a desirable balance is achieved between the overhang of the blades and the spacing between the drum and the pressure plate in order to move the cans into the nip and provide optimum flattening.

The crushing apparatus of the invention can be used to crush and flatten a wide variety of materials, such as metal cans, glass bottles, plastic bottles, and the like. As the operating components are not rubber-coated, the apparatus can be used to crush sharp materials, such as glass.

Various modes of carrying out the invention are contemplated as being within the scope of the following claims particularly pointing out and distinctly claiming the subject matter which is regarded as the invention.

We claim:

1. An apparatus for crushing articles, comprising a housing, a polygonal-shaped drum mounted for rotation within the housing having a plurality of generally flat surfaces, adjacent surfaces being connected at junctions, means to rotate the drum about its axis, a plurality of blades, each blade connected to one of said surfaces and having a forward tip portion projecting forward in the direction of the drum rotation from the respective junction, said tip portion being spaced radially outward from the next adjacent surface to provide an overhung tip disposed to engage the articles on rotation of the drum, the rear end of each blade being spaced forwardly of the tip of the next adjacent blade to provide a recess defined by said rear end and said one surface and the tip of the next adjacent blade, a pressure member disposed adjacent the drum, and resilient means to bias the pressure member toward the drum, said articles to be crushed being introduced into the space between the pressure member and the drum and being carried toward the nip between the drum and the pressure member by said recesses, said articles being gripped and carried into the nip by said tips and thereafter being progressively compressed by the outer surfaces of said blades.

2. The apparatus of claim 1 wherein said blades extend substantially the full length of the drum and are secured flatwise to the respective surfaces, and the projecting forward edges of the blades are sharpened.

3. The apparatus of claim 1, wherein said pressure plate is spaced from the circle inscribed by the rotating blades and said apparatus includes adjusting means to adjust the position of the pressure plate with respect to said drum.

4. The apparatus of claim 1, wherein said pressure member has a generally dog-leg shape to provide a converging space between the pressure member and said drum.

5. The apparatus of claim 1, wherein said resilient means interconnects the pressure member and a fixed support, and said apparatus includes a release mechanism to quickly disconnect said resilient means from one of said pressure member and said support.

6. The apparatus of claim 5, wherein said fixed support includes a slot and said resilient means extends through said slot and said release means includes locking means for locking the resilient means within the slot, release of said locking means enabling the resilient means to be withdrawn from said slot to thereby move the pressure member outwardly in a direction away from said drum.

7. An apparatus for crushing lightweight cans, comprising a housing, a polygonal-shaped drum mounted for rotation within the housing having a plurality of generally flat surfaces, adjacent surfaces being connected at junctions, means to rotate the drum about its axis, a plurality of blades, each blade being removably connected flatwise to one of said surfaces and having a sharpened tip projecting forwardly in the direction of drum rotation from a junction, said tip being spaced radially outward of the next adjacent surface to provide an undercut tip, said blade extending rearwardly from said junction and the rear end of each blade being spaced forwardly of the tip of the next adjacent blade, the rear end of each blade being spaced forwardly of the tip of the next adjacent blade to provide a recess defined by said rear end and said one surface and the tip of the next adjacent blade, a pressure member disposed adjacent the drum, and resilient means to bias the pressure member toward the drum, said cans to be crushed being introduced into the space between the pressure member and the drum and being carried toward the nip between the drum and the pressure member by said recesses, said cans being gripped and carried into the nip by said tips and thereafter being progressively compressed by the outer surfaces of said blades.

8. The apparatus of claim 7, wherein the inclined angle between adjacent surfaces is preferably in the range of 120° to 150°.

9. The apparatus of claim 7, and including a quick release mechanism to disconnect the resilient means from said pressure member to thereby enable said pressure member to be moved outwardly away from said drum.

10. The apparatus of claim 9, and including a fixed support member, said resilient means interconnecting said fixed support member and said pressure member, said fixed support member includes a slot, and said resilient means is pivotally connected to said pressure member and extends within said slot, said release mechanism includes a locking element for locking the resilient means in said slot, release of said locking element enabling said resilient means to be withdrawn from said slot, to thereby permit the pressure member to be moved outwardly away from said drum.

* * * * *

UNITED STATES PATENT AND TRADEMARK OFFICE

CERTIFICATE OF CORRECTION

PATENT NO. : 4,358,995

DATED : November 16, 1982

INVENTOR(S) : JAMES A. BALLO et al

It is certified that error appears in the above-identified patent and that said Letters Patent is hereby corrected as shown below:

On the title page.

At [74] Assignee: Cancel "VIVITAR CORPORATION, Santa Monica, Calif." and substitute therefor ---BALCON INDUSTRIES, INC., Milwaukee, Wisc.---; Col. 5, CLAIM 3, Line 45, Cancel "plate" and substitute therefor ---member---; Col. 5, line 47, CLAIM 3,, Cancel "plate" and substitute therefor ---member---

Signed and Sealed this

*Twenty-fourth* Day of *May 1983*

[SEAL]

*Attest:*

DONALD J. QUIGG

*Attesting Officer*

*Acting Commissioner of Patents and Trademarks*